US012551022B2

(12) United States Patent
Wu

(10) Patent No.: US 12,551,022 B2
(45) Date of Patent: Feb. 17, 2026

(54) FOLDING SOFA

(71) Applicant: Shanghai Wudi Home Furnishings Co Ltd, Shanghai (CN)

(72) Inventor: Peng Wu, Shanghai (CN)

(73) Assignee: Shanghai Wudi Home Furnishings Co Ltd, Shanghai (CN)

( * ) Notice: Subject to any disclaimer, the term of this patent is extended or adjusted under 35 U.S.C. 154(b) by 65 days.

(21) Appl. No.: 18/383,906

(22) Filed: Oct. 26, 2023

(65) Prior Publication Data

US 2025/0024954 A1 Jan. 23, 2025

(30) Foreign Application Priority Data

Jul. 17, 2023 (CN) ..... 202321877421.3

(51) Int. Cl.
*A47C 17/16* (2006.01)

(52) U.S. Cl.
CPC ..... *A47C 17/162* (2013.01); *A47C 17/161* (2013.01); *A47C 17/16* (2013.01)

(58) Field of Classification Search
CPC ..... A47C 17/162; A47C 17/161; A47C 17/16
USPC ..... 5/12.1, 37.1, 38
See application file for complete search history.

(56) References Cited

U.S. PATENT DOCUMENTS 1,192,318 A * 7/1916 Inco ..... A47C 17/16 5/55.1
1,817,708 A * 8/1931 Pintow ..... A47C 17/162 297/110
1,926,915 A * 9/1933 Ramirez ..... A47C 17/207 297/109
2,240,204 A * 4/1941 Bell ..... A47C 17/2076 297/316
2,597,860 A * 5/1952 Gerber et al. ..... A47C 4/02 297/411.28
2,829,707 A * 4/1958 Liebson ..... A47C 4/028 297/411.42
3,201,805 A * 8/1965 Smith ..... A47C 17/2073 5/55.1

(Continued)

FOREIGN PATENT DOCUMENTS

CN 220256093 U * 12/2023 ..... A47C 13/005
DE 202024100780 U1 * 4/2024 ..... A47C 13/005

(Continued)

*Primary Examiner* — Robert G Santos
(74) *Attorney, Agent, or Firm* — Bayramoglu Law Offices LLC

(57) ABSTRACT

A folding sofa is provided. The folding sofa includes multiple folding parts, where the folding parts include seat cushion frames, backrest frames, rotating locking elements, and support elements; the seat cushion frame and the backrest frame are rotationally connected, and are locked by the rotating locking element; the support element is provided inside the seat cushion frame and the backrest frame; multiple first seat cushion support legs are detachably provided below the first seat cushion frame, and multiple last seat cushion support legs are detachably provided below the last seat cushion frame; multiple common seat cushion support legs are detachably provided between each two adjacent seat cushion frames; and the backrest frame is provided with multiple backrest support legs for supporting when the folding sofa is used as a bed.

10 Claims, 11 Drawing Sheets

(56) References Cited

U.S. PATENT DOCUMENTS

| | | | | | |
|---|---|---|---|---|---|
| 3,317,930 | A * | 5/1967 | Wiberg | A47C 17/17 | 5/45 |
| 4,165,902 | A * | 8/1979 | Ehrlich | A47C 4/02 | 297/440.11 |
| 4,221,428 | A * | 9/1980 | Bowman | A47C 3/18 | 5/28 |
| 5,722,101 | A * | 3/1998 | Grigoriev | A47C 17/161 | 297/423.27 |
| 6,796,614 | B1 * | 9/2004 | Paul | A47C 7/42 | 297/118 |
| 11,412,855 | B2 * | 8/2022 | Kim | A47C 4/283 | |
| 12,096,861 | B2 * | 9/2024 | Shao | A47C 17/04 | |
| 2003/0140422 | A1 * | 7/2003 | Sama | A47C 31/00 | 5/658 |
| 2011/0016626 | A1 * | 1/2011 | Kanthasamy | A47C 17/16 | 5/37.1 |
| 2021/0153658 | A1 * | 5/2021 | Kim | A47C 17/04 | |
| 2024/0148148 | A1 * | 5/2024 | Shao | A47C 4/028 | |
| 2025/0024954 | A1 * | 1/2025 | Wu | A47C 17/162 | |

FOREIGN PATENT DOCUMENTS

| | | | | |
|---|---|---|---|---|
| EP | 2868234 | A1 * | 5/2015 | A47C 13/005 |
| FR | 3012730 | A1 * | 5/2015 | A47C 13/005 |
| FR | 3151188 | A3 * | 1/2025 | A47C 13/005 |
| JP | 3246433 | U * | 4/2024 | A47C 13/005 |

* cited by examiner

FOLDING SOFA

CROSS REFERENCE TO THE RELATED APPLICATIONS

This application is based upon and claims priority to Chinese Patent Application No. 202321877421.3, filed on Jul. 17, 2023, the entire contents of which are incorporated herein by reference.

TECHNICAL FIELD

The present disclosure relates to the technical field of sofas, and in particular to a folding sofa, preferably a folding sofa with a single-layer iron tube structure.

BACKGROUND

Sofas are very common household furniture, and there are many types of sofas, for example, folding sofas. Folding sofas can serve as beds and are very practical.

In the related art, a folding sofa includes a seat cushion frame, a backrest frame, a support element (such as a spring), and a rotating locking element (such as a joint hinge). The seat cushion frame and the backrest frame are rotationally connected, and are locked by the rotating locking element. The support element is provided inside the seat cushion frame and the backrest frame. Multiple seat cushion support legs are located below the seat cushion frame. Backrest support legs are provided at the back of the backrest frame. When the folding sofa is used as a regular sofa, the seat cushion frame and the backrest frame are rotated to a first preset angle (such as 90-130 degrees). At this point, the seat cushion frame and the backrest frame are locked by the rotating locking element and supported by the seat cushion support legs to form the regular sofa, allowing a user to sit on the support element. When the folding sofa is used as a bed, the seat cushion frame and the backrest frame are rotated to a second preset angle (such as 180 degrees). At this point, the seat cushion frame and the backrest frame are locked by the rotating locking element and supported by the seat cushion support legs and folding support legs to form the bed, allowing the user to lie on the support element.

In the related art, when the length of the folding sofa is large, such as when the length of the seat cushion frame and the backrest frame is large, the overall surface area of the folding sofa is large. As a result, the folding sofa will occupy a large surface area in a packing box, thus making it inconvenient to pack and store.

SUMMARY

In view of defects in the prior art, an objective of the present disclosure is to provide a folding sofa.

According to the present disclosure, the folding sofa includes multiple folding parts, where

- the folding parts include seat cushion frames, backrest frames, rotating locking elements, and support elements;
- the seat cushion frame and the backrest frame are rotationally connected, and are locked by the rotating locking element;
- the support element is provided inside the seat cushion frame and the backrest frame;
- multiple first seat cushion support legs are detachably provided below the first seat cushion frame, and multiple last seat cushion support legs are detachably provided below the last seat cushion frame;
- multiple common seat cushion support legs are detachably provided between each two adjacent seat cushion frames; and
- the backrest frame is provided with multiple backrest support legs for supporting when the folding sofa is used as a bed.

Preferably, the support element includes multiple elastic elements; and two ends of each of the elastic elements are fixed inside the seat cushion frame and the backrest frame.

Preferably, the folding parts further include a soft elastic element; and

- the soft elastic element is provided on the elastic element inside the seat cushion frame and the backrest frame.

Preferably, the folding parts are wrapped in a flexible covering.

Preferably, the rotating locking element is provided between the backrest frame and the backrest support leg; and

- the backrest support leg is rotationally connected to the backrest frame, and the backrest frame and the backrest support leg are connected and locked by the rotating locking element.

Preferably, the seat cushion frame and the backrest frame are made of iron or steel tubes.

Preferably, the flexible covering is provided with a zipper for easy placement of the folding part.

Preferably, the zipper is located below the folding part.

Preferably, the folding sofa further includes multiple fixing elements; and

- the first seat cushion support legs, the common seat cushion support legs, and the last seat cushion support legs are detachably provided on the seat cushion frame by the fixing elements.

Preferably, the folding sofa includes a futon sofa, a tatami sofa, a chaise sectional sofa, or a cube sofa.

Compared with the prior art, the present disclosure has the following beneficial effects:

1. In the present disclosure, when a long folding sofa needs to be packed and stored, the first seat cushion support legs, the last seat cushion support legs, and the common seat cushion support legs are disassembled from the seat cushion to form multiple folding parts, reducing the overall surface area of the folding sofa. In addition, among the folding parts, the seat cushion frame and the backrest frame are rotatable to overlap and be fixed together by the rotating locking element, further reducing the overall surface area of the folding sofa. This design reduces the surface area of the packing box occupied by the folding sofa, facilitates packing and storage, and saves the material of the packing box.

2. In the present disclosure, the seat cushion frame and the backrest frame are made of iron or steel tubes, enhancing the strength of the folding sofa and improving durability and load-bearing capacity of the folding sofa.

3. In the present disclosure, the support element uses an elastic element, which improves the overall elasticity and comfort of the folding sofa.

BRIEF DESCRIPTION OF THE DRAWINGS

Other features, objectives, and advantages of the present disclosure will become more apparent by reading the detailed description of non-limiting embodiments with reference to the following drawings.

Figure 1:
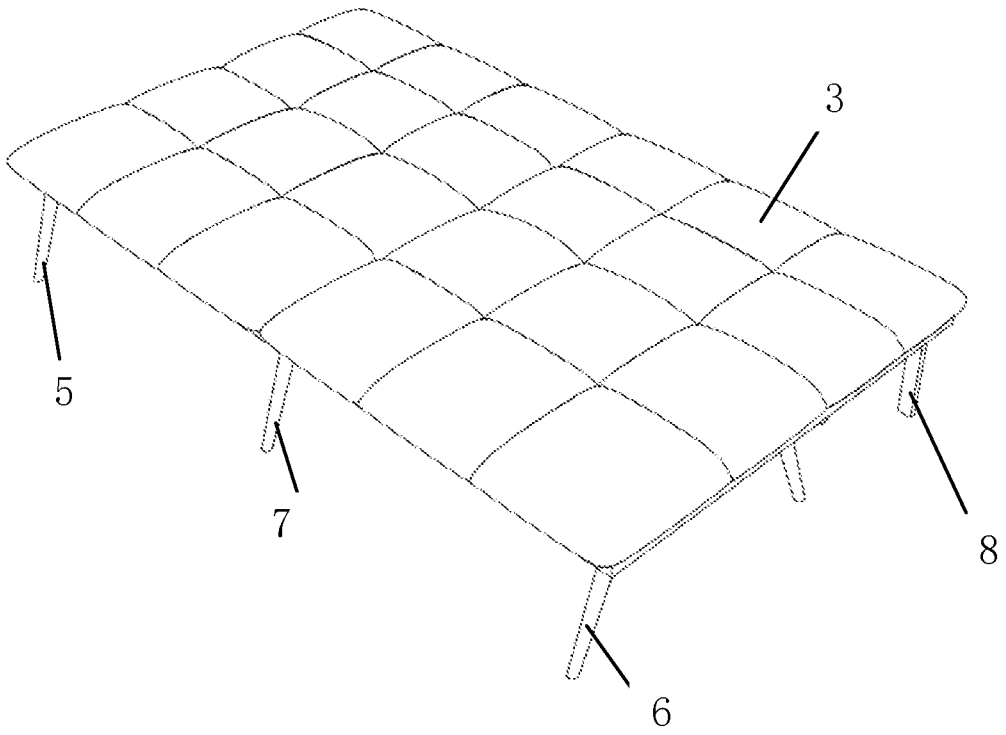
FIG. 1 is a structural diagram of a folding sofa that is laid flat according to the present disclosure.

| Reference Numerals: |
| --- |
| 1. seat cushion frame |
| 2. backrest frame |
| 3. flexible covering |
| 4. spring |
| 5. first seat cushion support leg |
| 6. last seat cushion support legs |
| 7. common seat cushion support leg |
| 8. backrest support leg |

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

Figure 4:
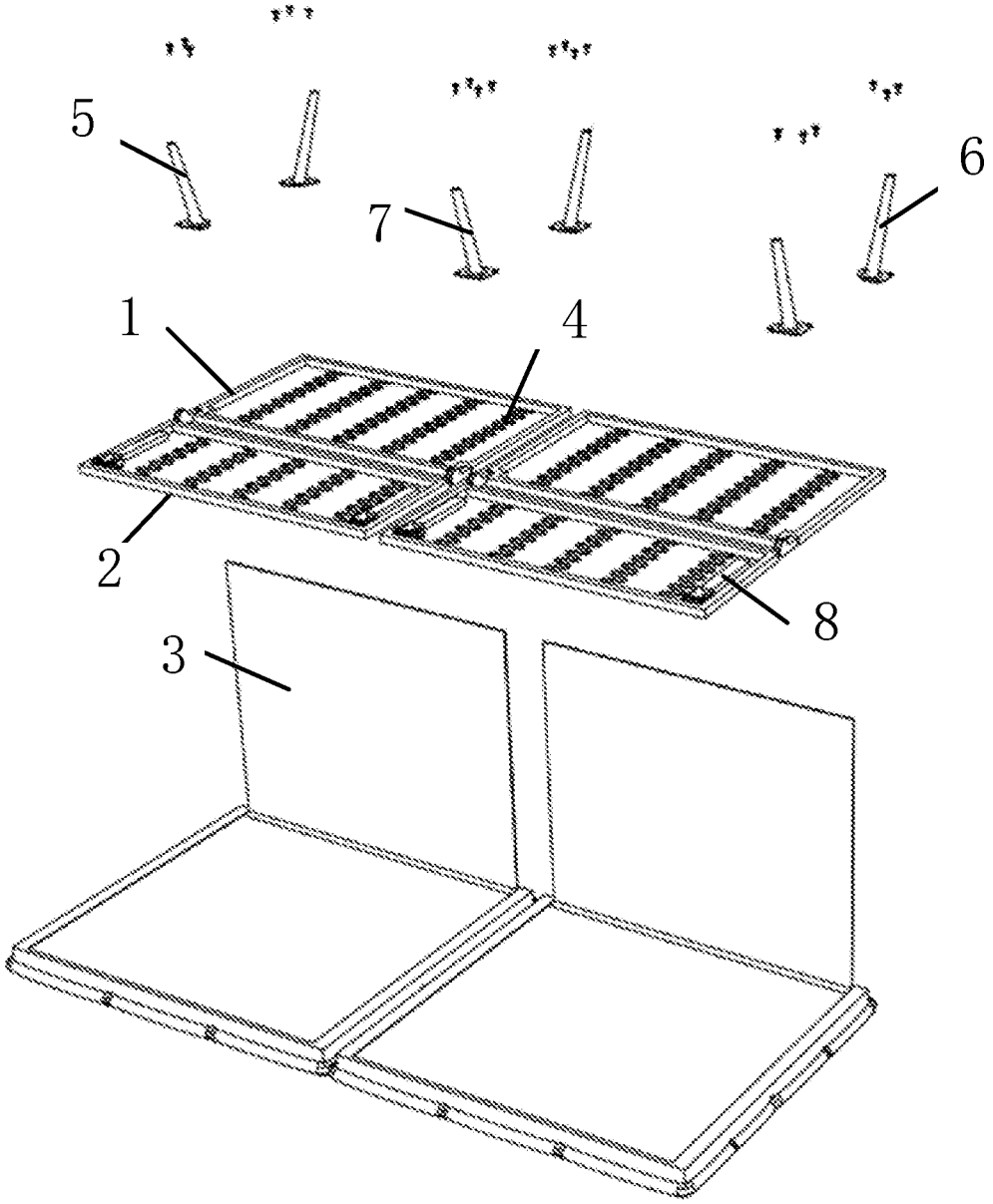
FIG. 4 is an exploded view of the folding sofa according to the present disclosure.

An embodiment of the present disclosure provides a folding sofa with a single-layer iron tube structure. As shown in FIGS. 1 and 4, the folding sofa includes multiple folding parts. The folding parts include seat cushion frames 1, backrest frames 2, rotating locking elements, soft elastic elements, and a support element. The seat cushion frame 1 and the backrest frame 2 are rotationally connected, and are locked by the rotating locking element. The support element is provided inside the seat cushion frame 1 and the backrest frame 2. Multiple first seat cushion support legs 5 are detachably provided below the first seat cushion frame 1, and multiple last seat cushion support legs 6 are detachably provided below the last seat cushion frame 1. Multiple common seat cushion support legs 7 are detachably provided between each two adjacent seat cushion frames 1. The backrest frame 2 is provided with multiple backrest support legs 8 for supporting when the folding sofa is used as a bed. There is a freely adjustable angle between the seat cushion frame 1 and the backrest frame 2. When the folding sofa is used as a sofa, the seat cushion frame 1 and the backrest frame 2 are at an angle of 90-130 degrees. The rotating locking element between the seat cushion frame 1 and the backrest frame 2 is, for example, a joint hinge available on the market, and can be fixed and adjusted freely. For example, two, three, four, or five folding parts extend infinitely in a straight line.

The support element includes multiple elastic elements. Two ends of each of the elastic elements are fixed inside the seat cushion frame 1 and the backrest frame 2. The elastic element includes spring 4, and the spring 4 is an S-shaped spring.

A soft elastic element is provided on the elastic element inside the seat cushion frame and the backrest frame. The soft elastic element is a soft sponge. The folding part is also wrapped in flexible covering 3. The flexible covering 3 forms a skin. To store the folding sofa, the soft sponge is put into the flexible covering 3, and the flexible covering 3 is vacuumed for easy stacking. The flexible covering 3 is provided with a zipper for easy placement of the folding part. The zipper is located below the folding part.

The rotating locking element is provided between the backrest frame 2 and the backrest support leg 8. The backrest support leg 8 is rotationally connected to the backrest frame 2, and the backrest frame 2 and the backrest support leg 8 are connected and locked by the rotating locking element. The rotating locking element is, for example, a self-locking folding hinge available on the market. When the self-locking folding hinge is in an opened state, it can be locked at an angle of 90 degrees. When the self-locking folding hinge is pressed, it is unlocked, and can be folded at an angle of 0 degree for storage without rebounding. The backrest support legs 8 are retractable, and are specifically retractable rods that are fixed by bolts. When the folding sofa is used as a bed, an extension length of folding support legs is determined by a tilt angle of the folding sofa, and the seat cushion frame 1 and the backrest frame 2 are at a maximum angle of 180 degrees.

The seat cushion frame 1 and the backrest frame 2 are made of iron or steel tubes. Specifically, the seat cushion frame 1 and the backrest frame 2 are made of steel square tubes, steel round tubes, single-layer iron tubes, etc.

The folding sofa further includes multiple fixing elements. The first seat cushion support legs 5, the common seat cushion support legs 7, and the last seat cushion support legs 6 are detachably provided on the seat cushion frame 1 by the fixing elements. The fixing elements are bolts that are threaded into screw holes of the seat cushion frame 1.

The folding sofa includes a futon sofa, a tatami sofa, a chaise sectional sofa, or a cube sofa, etc.

The folding sofa is a sofa structure that can be laid flat. The folding sofa includes two parts, namely a seat cushion and a backrest. A connecting hinge is provided between the seat cushion and the backrest, allowing the seat cushion and the backrest to be fixed at a certain angle. The backrest can be laid down to form a flat surface. The backrest is provided with legs that are foldable for storage. When the backrest is laid down to form a flat surface, the legs serve as a support. The folding sofa is actually a multifunctional sofa that is switched between a sofa and a bed. The folding sofa features simple and fast assembly and a split design that is convenient for storage. The seat cushion and the backrest are made of a soft sponge and a skin for easy vacuum for storage. The main frame is welded with steel square tubes, increasing the strength of the folding sofa. The folding sofa is provided with the S-shaped springs 4, which increase the overall elasticity and comfort of the folding sofa. The upholstered parts of the seat cushion and the backrest are detachably provided on the backrest frame 2 by the zipper at the bottom of the seat cushion.

Figure 2:
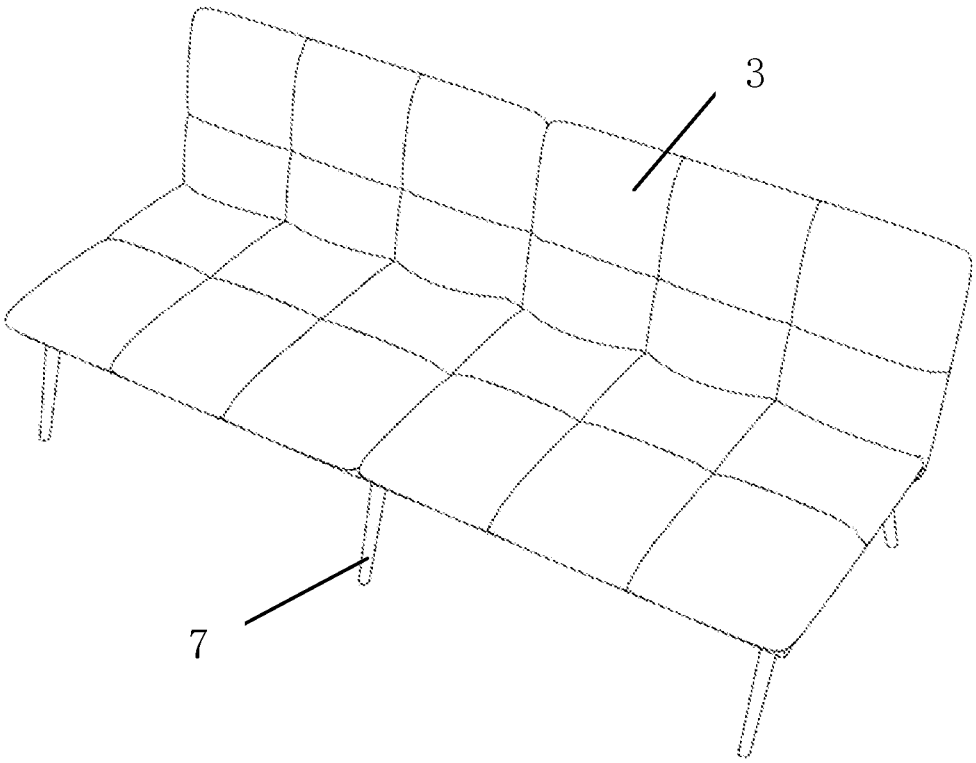
FIG. 2 is a structural diagram of the folding sofa in normal use according to the present disclosure.
Figure 3:
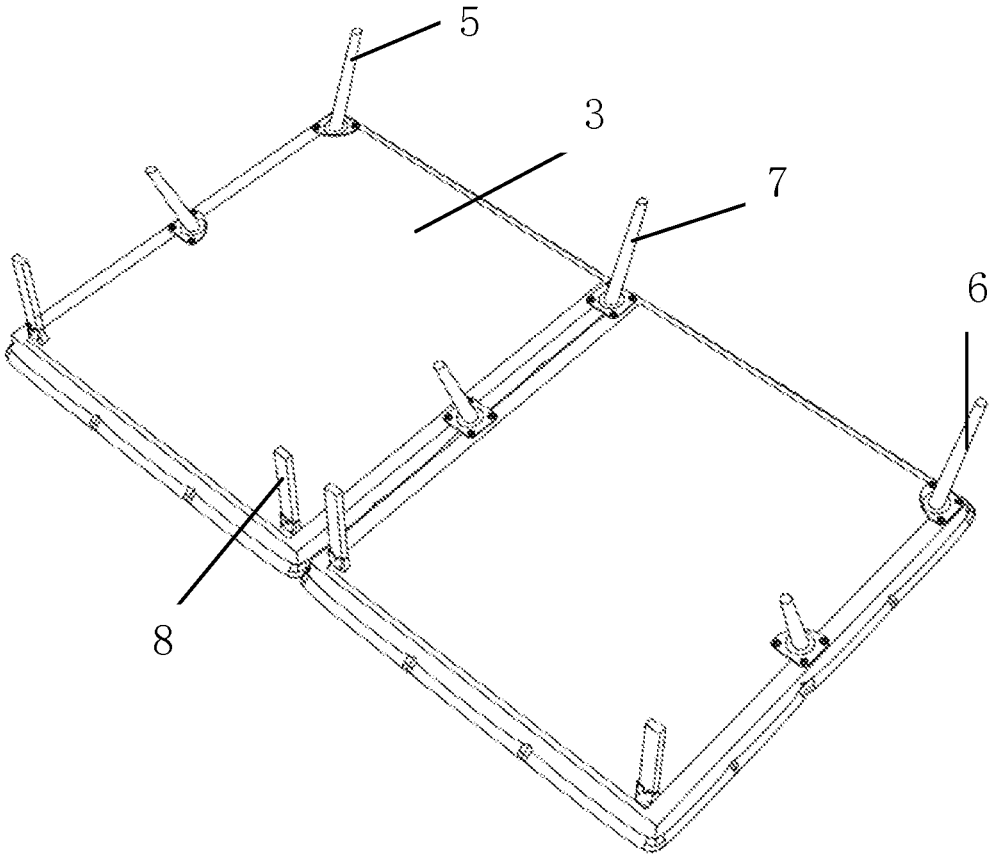
FIG. 3 is a bottom view of the folding sofa according to the present disclosure.
Figure 5:
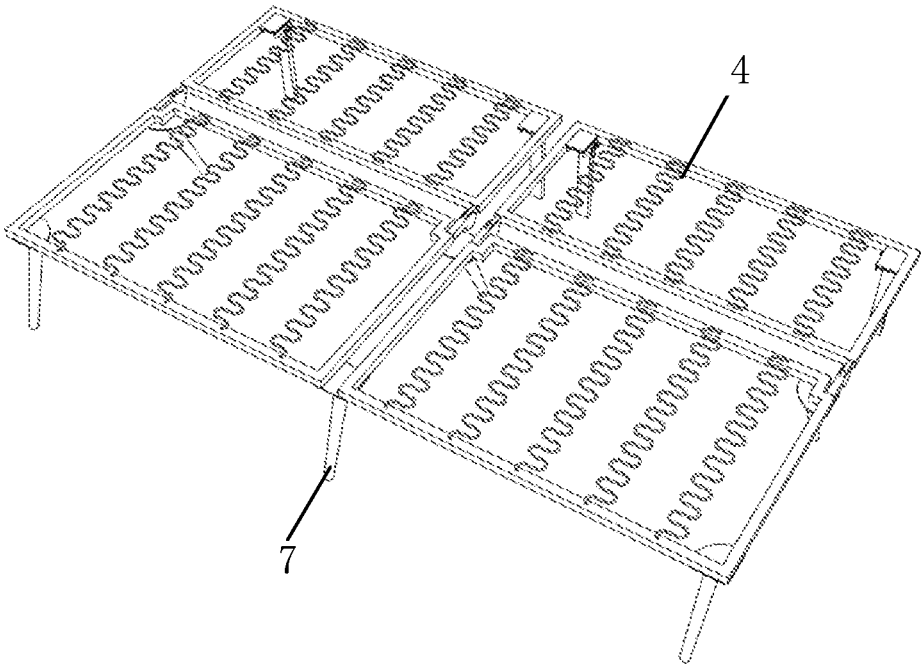
FIG. 5 is a schematic diagram of an internal frame of the folding sofa that is laid flat according to the present disclosure.
Figure 6:
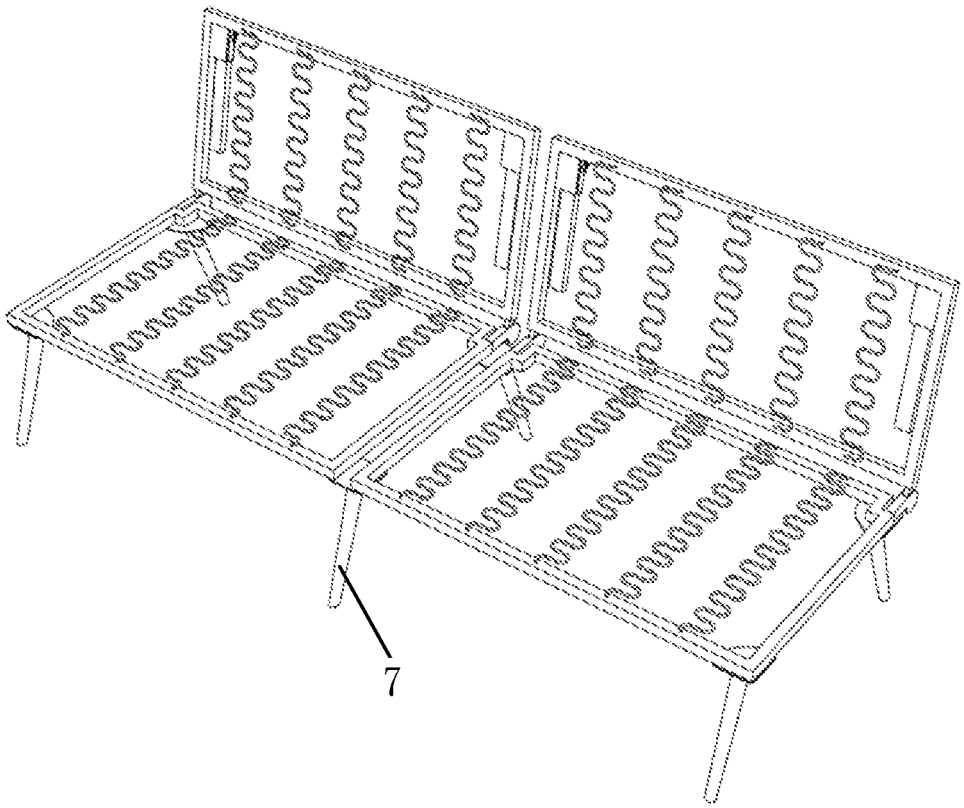
FIG. 6 is a schematic diagram of the internal frame of the folding sofa in normal use according to the present disclosure.
Figure 7:
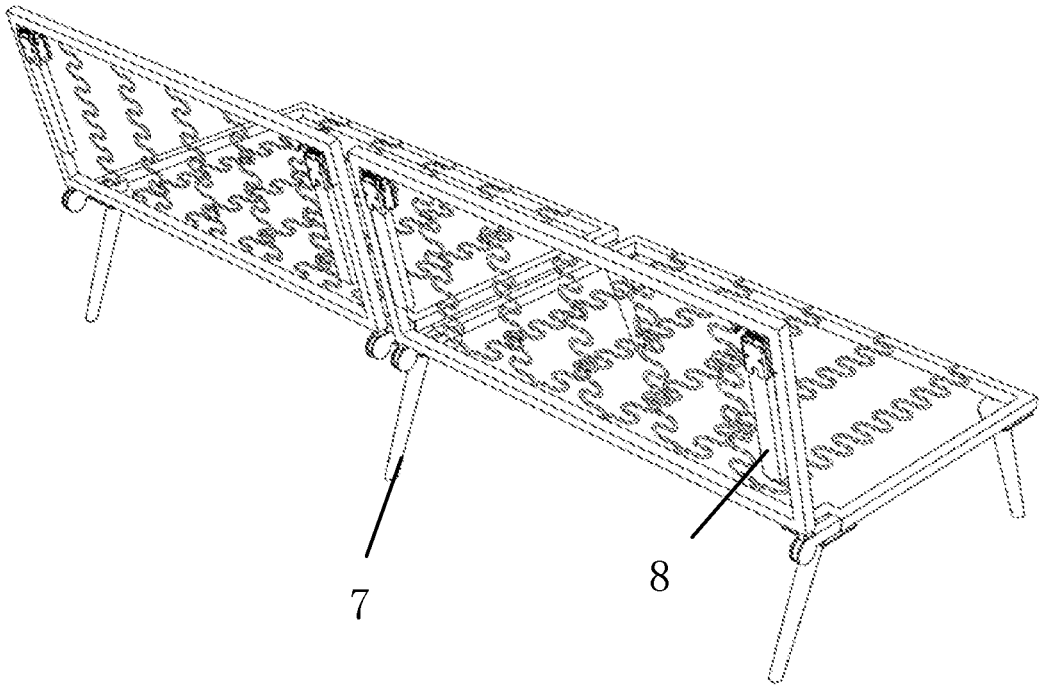
FIG. 7 is a schematic diagram of folding legs at a back of the folding sofa according to the present disclosure.
Figure 8A:
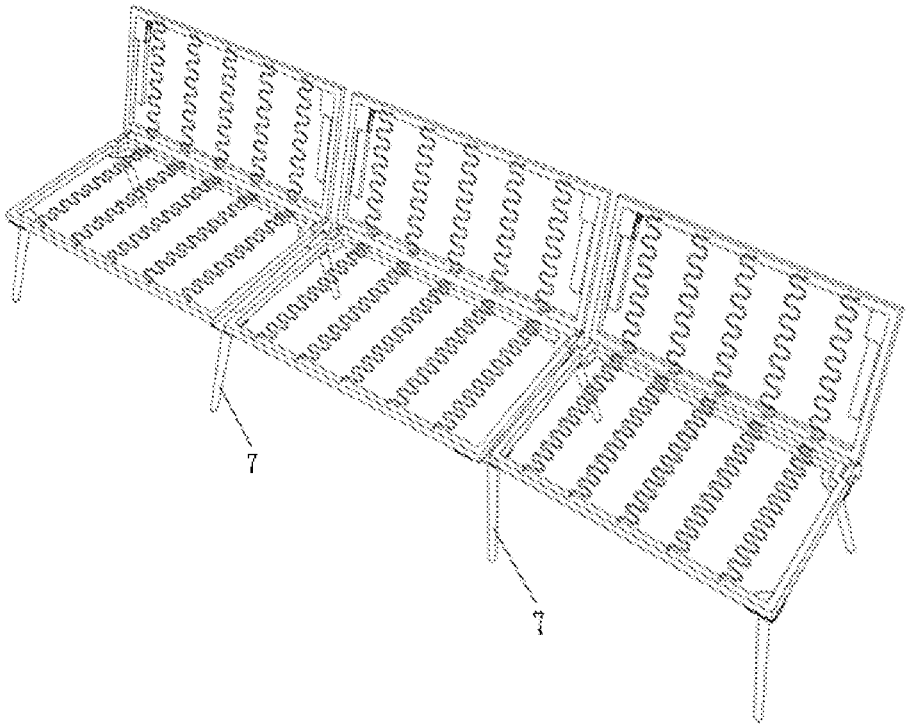
FIGS. 8A-8C show a schematic diagram of folding single frames of the folding sofa according to the present disclosure.
Figure 8B:
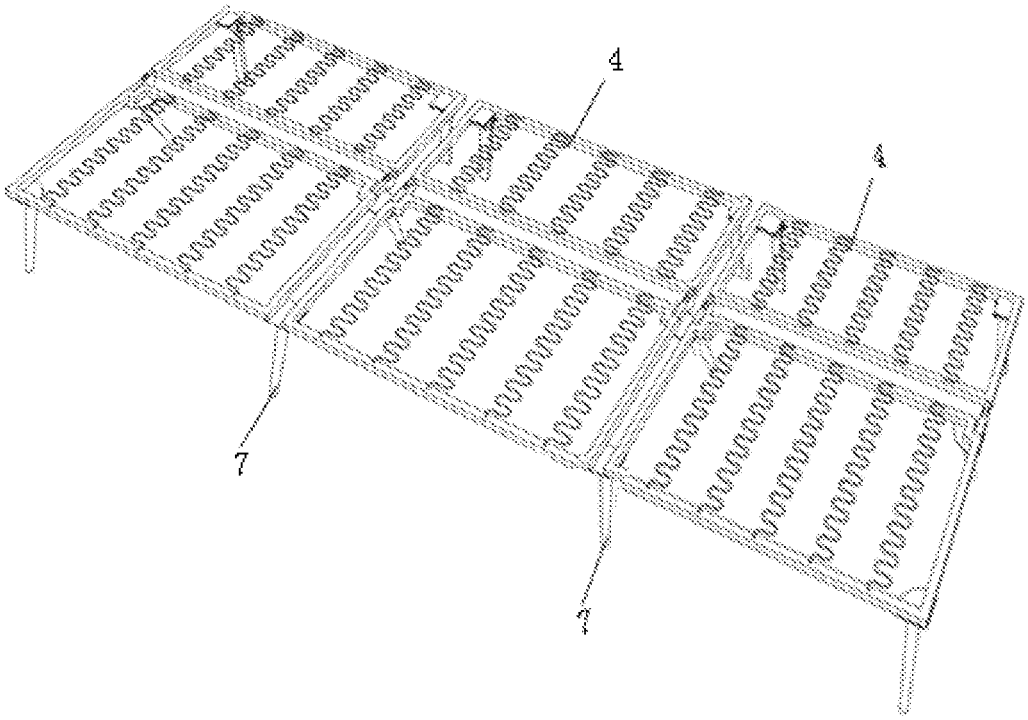
Figure 8C:
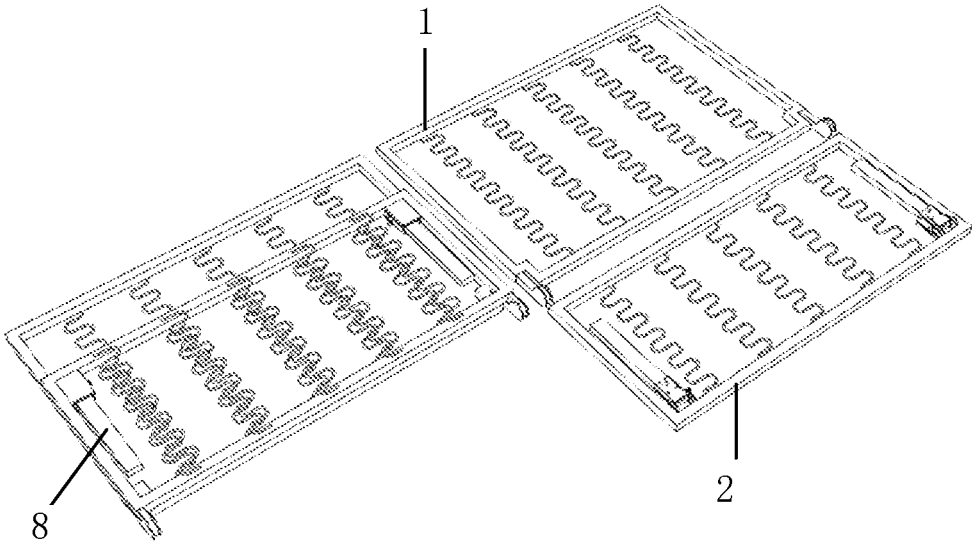
Figure 9:
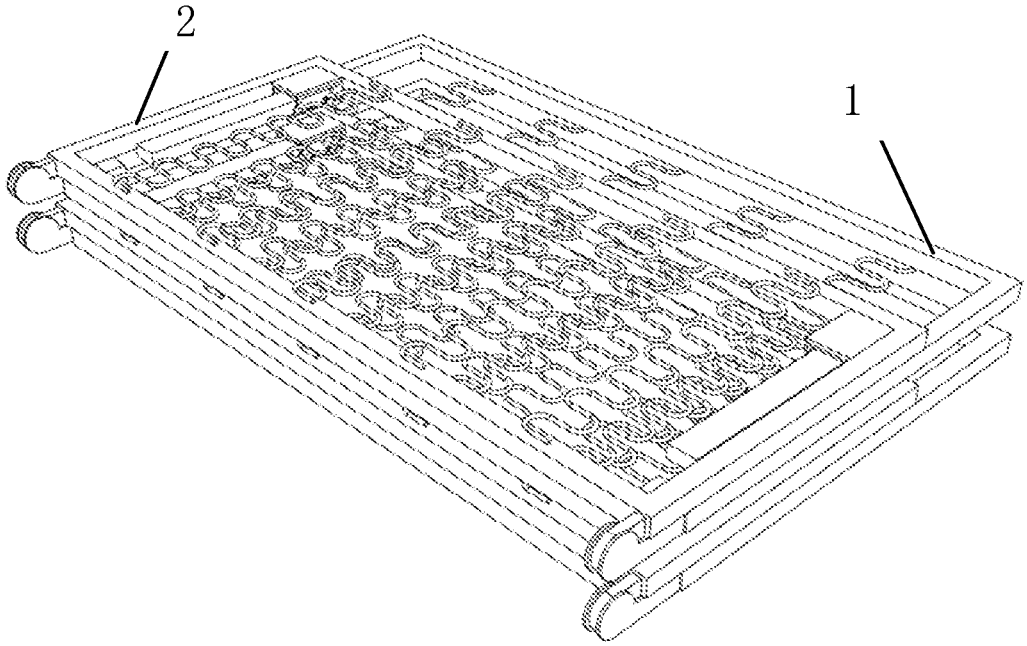
FIG. 9 is a schematic diagram of two stacks of folded frames of the folding sofa according to the present disclosure.
Figure 10:
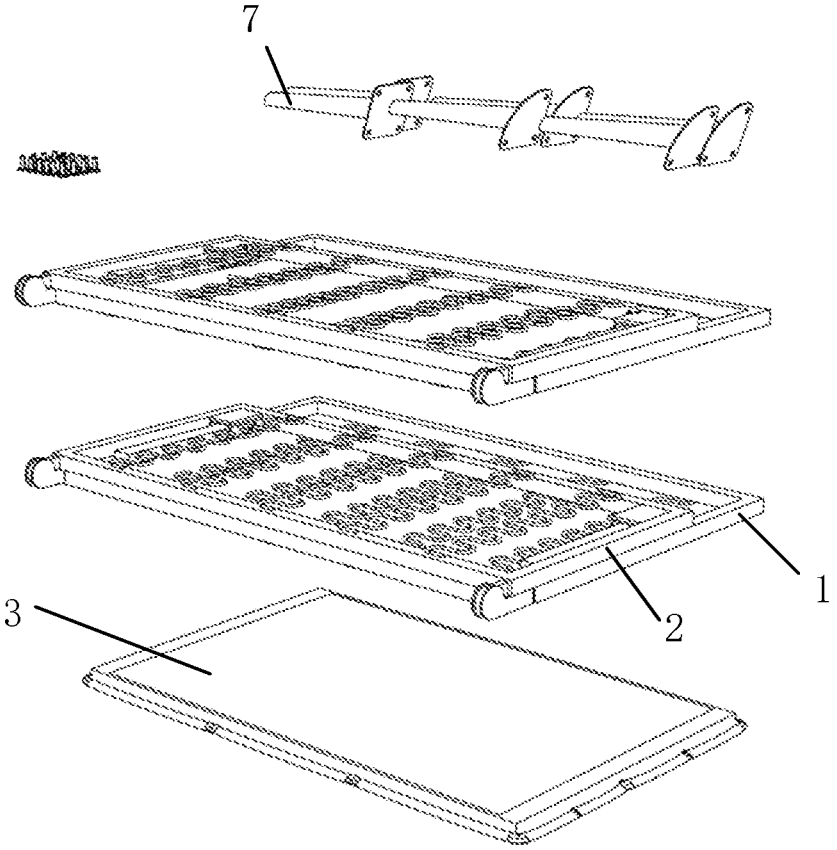
FIG. 10 is a schematic diagram of elements of the folding sofa in the stacks in a packed state according to the present disclosure.
Figure 11:
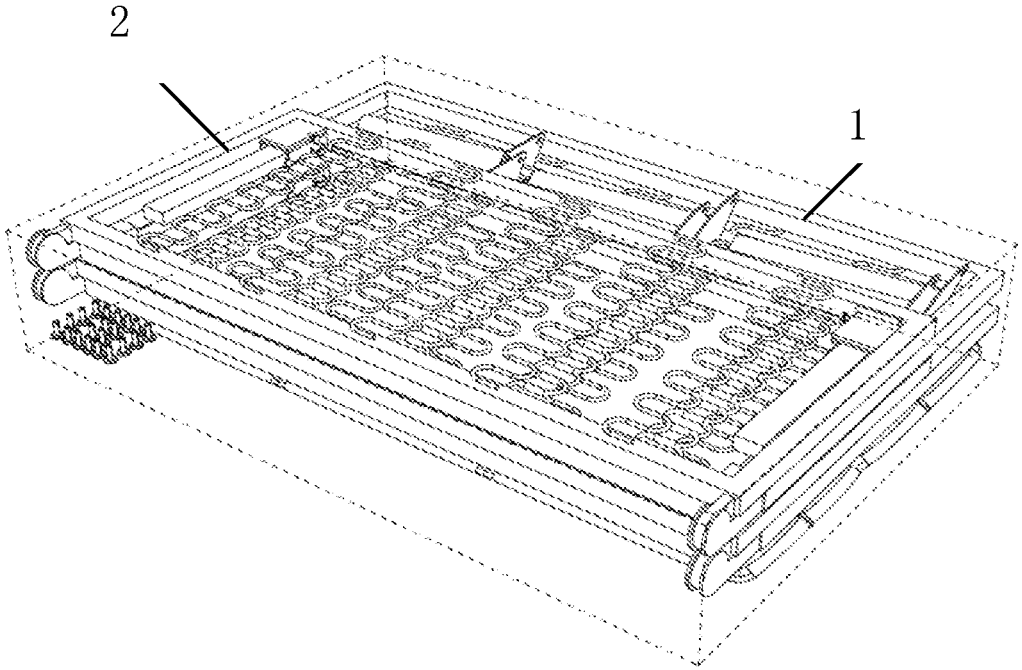
FIG. 11 is a schematic diagram of the stacks in the packed state according to the present disclosure.

As shown in FIG. 1, the folding sofa is laid down and can be used as a bed. The legs at the back of the backrest are put down to serve as a support. As shown in FIG. 2, when the folding sofa is used as a sofa, the legs of the backrest are folded and stored inside the backrest. As shown in FIG. 3, the folding sofa includes two identical sofa parts, which are connected by common legs. After the legs are disassembled, the folding sofa is divided into two small parts, reducing the size of the folding sofa and saving packing and storage space. As shown in FIG. 4, the frame part can be placed inside the folding sofa and sealed with the zipper. The corresponding mounting positions of the legs are provided with screw holes for easy mounting. The internal frame of the folding sofa is shown in FIGS. 5 and 6. As shown in FIG. 7, the legs at the back can be folded and stored. As shown in FIGS. 8A-8C, single frames can be folded to reduce the packing size. As shown in FIG. 9, after being folded, two frames can be stacked together. FIG. 10 shows the distribution of the elements of the folding sofa in a packed state. The seat cushion is vacuumed to reduce the space for stacking. As shown in FIG. 11, the stacked storage effectively reduces the packing space.

The folding sofa according to the present disclosure can be used individually or in the form of a combined sofa by combinations.

In the description of the present application, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the drawings, are merely for facilitating the description of the present application and simplifying the description, rather than indicating or implying that an apparatus or element referred to must have a particular orientation or be constructed and operated in a particular orientation, and therefore shall not be interpreted as limiting the present application.

The particular embodiments of the present disclosure are described as above. It should be understood that the present disclosure is not limited to the above specific embodiments. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A folding sofa, comprising multiple folding parts, wherein the folding parts comprise seat cushion frames, backrest frames, rotating locking elements, and support elements;

the seat cushion frames and the backrest frames are rotationally connected, and are locked by the rotating locking elements;

the support elements are provided inside the seat cushion frames and the backrest frames;

multiple first seat cushion support legs are detachably provided below a first seat cushion frame, and multiple last seat cushion support legs are detachably provided below a last seat cushion frame;

multiple common seat cushion support legs are detachably provided between two adjacent seat cushion frames; and the backrest frames are provided with multiple backrest support legs for supporting when the folding sofa is configured as a bed.

2. The folding sofa according to claim 1, wherein the support elements comprise multiple elastic elements; and two ends of each of the elastic elements are fixed inside the seat cushion frames and the backrest frames.

3. The folding sofa according to claim 2, wherein the folding parts further comprise a soft elastic element; and the soft elastic element is provided on the elastic elements inside the seat cushion frames and the backrest frames.

4. The folding sofa according to claim 1, wherein the folding parts are wrapped in a flexible covering.

5. The folding sofa according to claim 1, wherein the rotating locking elements are provided between the backrest frames and the backrest support legs; and the backrest support legs are rotationally connected to the backrest frames, and the backrest frames and the backrest support legs are connected and locked by the rotating locking elements.

6. The folding sofa according to claim 1, wherein the seat cushion frames and the backrest frames are made of iron or steel tubes.

7. The folding sofa according to claim 4, wherein the flexible covering is provided with a zipper for an easy placement of the folding parts.

8. The folding sofa according to claim 7, wherein the zipper is located below the folding parts.

9. The folding sofa according to claim 1, wherein the folding sofa further comprises multiple fixing elements; and the first seat cushion support legs, the common seat cushion support legs, and the last seat cushion support legs are detachably provided on the seat cushion frames by the fixing elements.

10. The folding sofa according to claim 1, wherein the folding sofa comprises a futon sofa, a tatami sofa, a chaise sectional sofa, or a cube sofa.

* * * * *